United States Patent [19]

Kawatsura et al.

[11] 4,299,476

[45] Nov. 10, 1981

[54] IMAGE FORMING PROCESS AND APPARATUS THEREFOR

[75] Inventors: Yoshihiro Kawatsura, Kawasaki; Katsuichi Shimizu, Hoya; Hisashi Sakamaki, Yokohama, all of Japan

[73] Assignee: Canon Kabushiki Kaisha, Tokyo, Japan

[21] Appl. No.: 37,843

[22] Filed: May 10, 1979

Related U.S. Application Data

[63] Continuation of Ser. No. 891,852, Mar. 30, 1978, Pat. No. 4,202,622.

[30] Foreign Application Priority Data

Apr. 6, 1977 [JP] Japan ..... 52/39857
Apr. 6, 1977 [JP] Japan ..... 52/39858

[51] Int. Cl.[3] ..... G03G 15/00
[52] U.S. Cl. ..... 355/14 C
[58] Field of Search ..... 355/14 C, 14 R, 3 R; 364/900 MS File, 200 MS File

[56] References Cited

U.S. PATENT DOCUMENTS 4,035,072 7/1977 Deetz et al. ..... 355/14
4,062,061 12/1977 Batchelor et al. ..... 355/14 X

*Primary Examiner*—R. L. Moses
*Attorney, Agent, or Firm*—Fitzpatrick, Cella, Harper & Scinto

[57] ABSTRACT

An image forming apparatus includes a recording member, image forming devices for forming an image on the recording member, a detector for detecting the state of the apparatus and a digital control having a stored main program for actuating the elements for image formation, wherein the digital controller includes a stored program to be executed upon interruption of the execution of the stored main program and an input port for causing execution of the interruption program, and the detecting means being connected to the input port to cause, in response to the detection signals, the execution of the interrupt program in response to the detected state.

16 Claims, 22 Drawing Figures

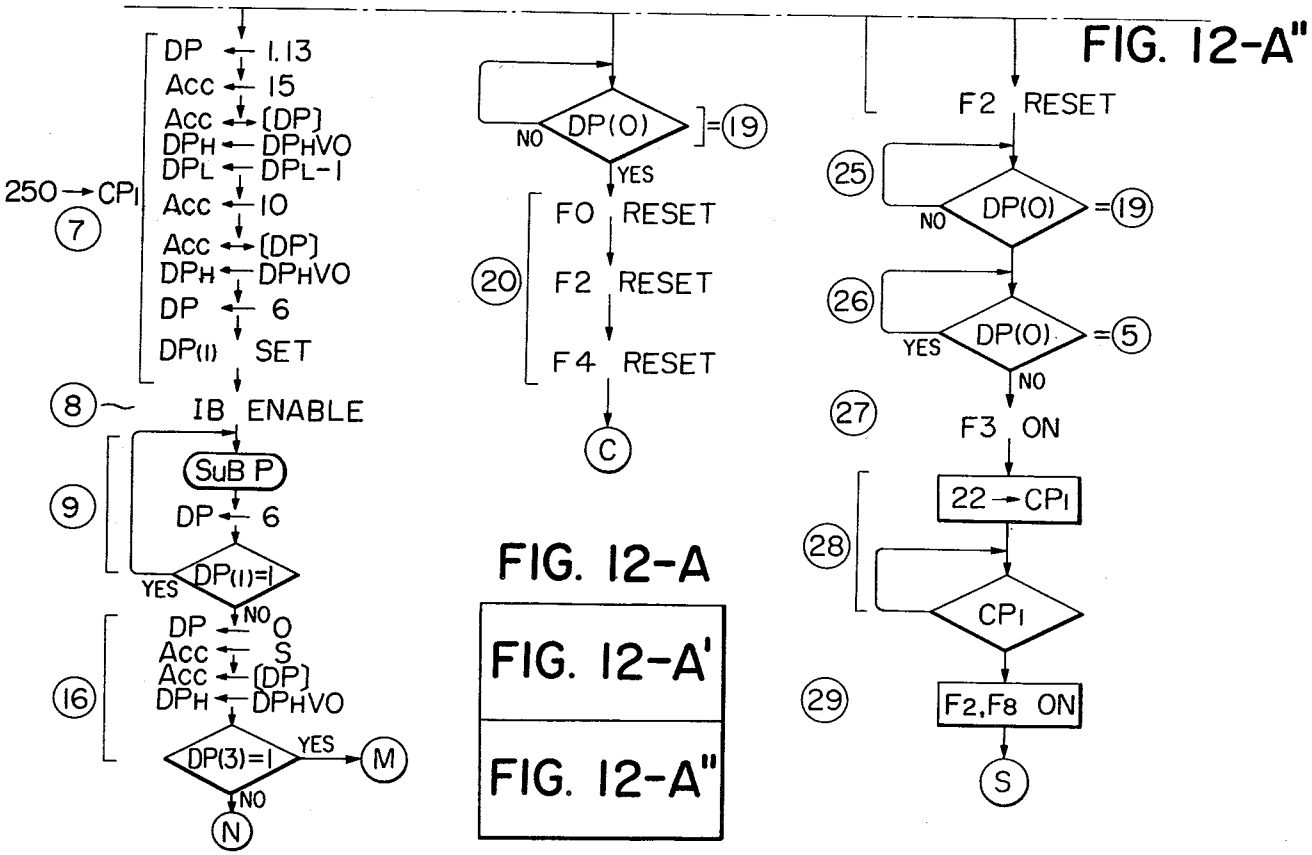
FIG. 12-A
| FIG. 12-A' |
|---|
| FIG. 12-A" |

FIG. 12-A'
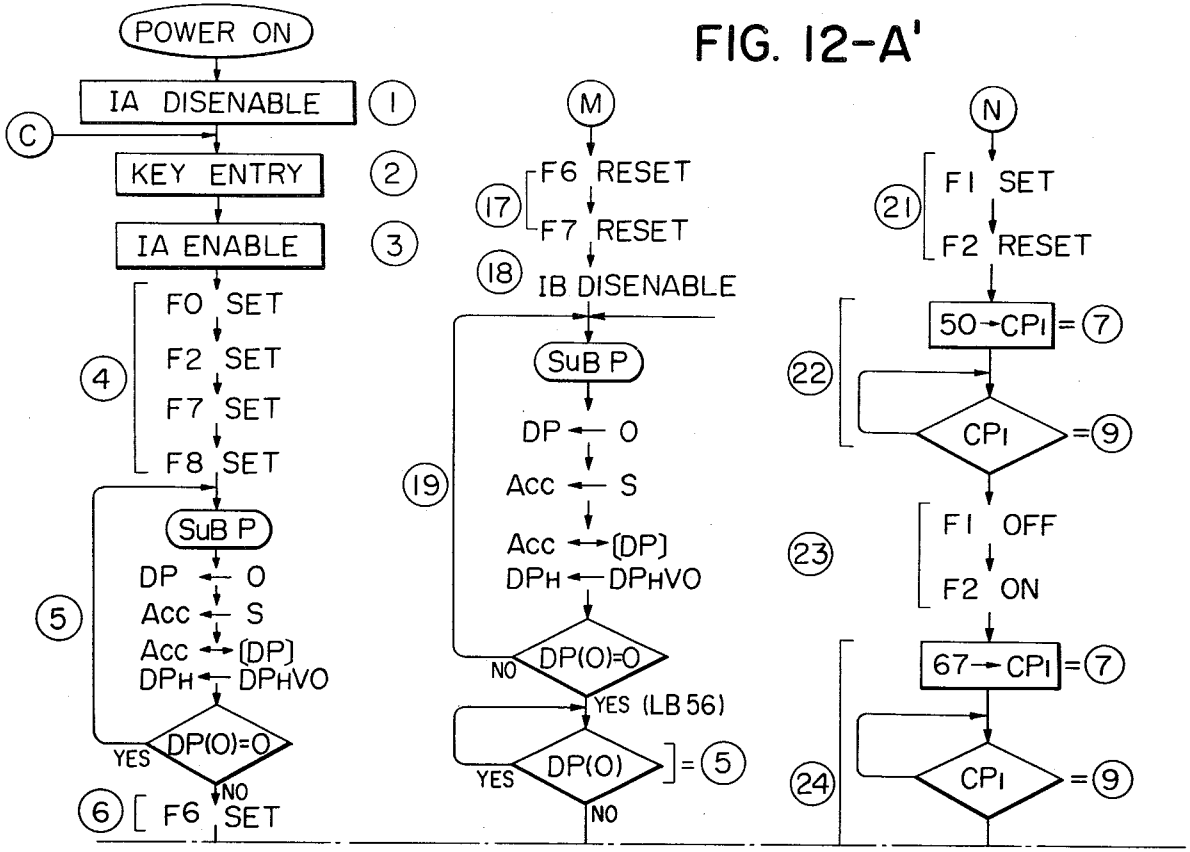

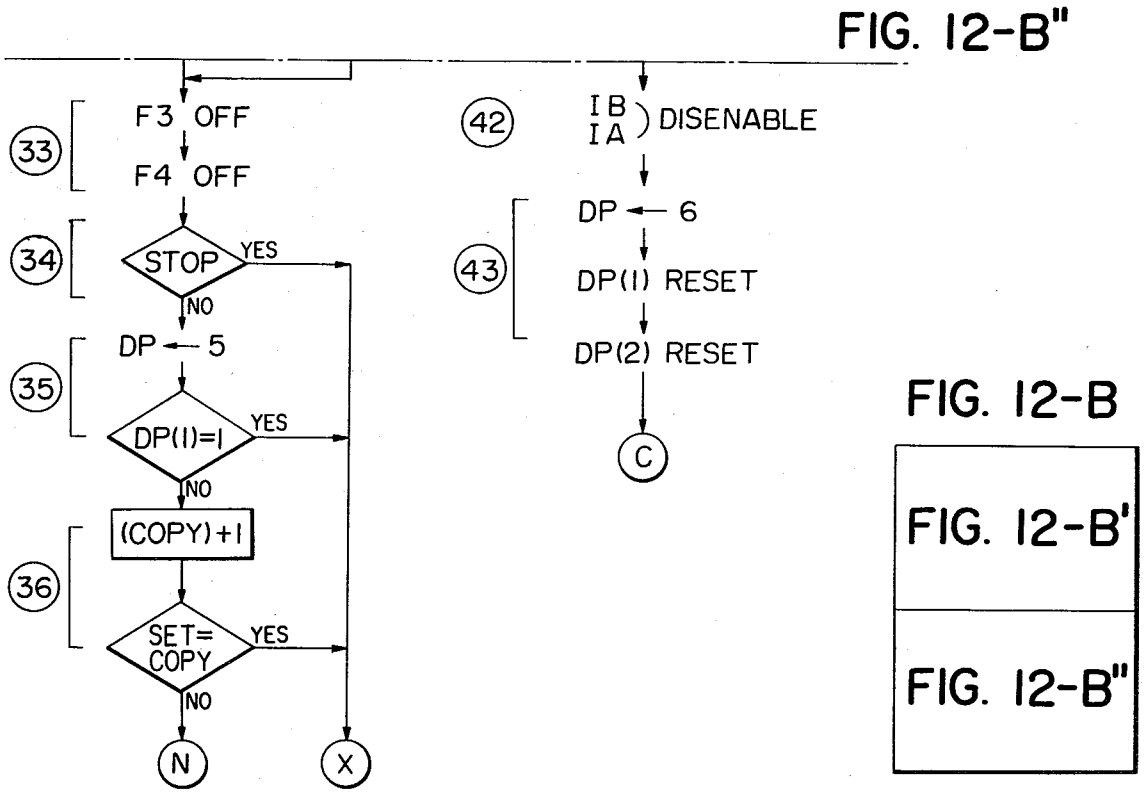
FIG. 12-B"
F3 OFF
F4 OFF
33
STOP
YES
NO
34
DP ← 5
DP(I)=I
YES
NO
35
(COPY)+I
SET= COPY
YES
NO
36
X
N
IB
IA
DISENABLE
42
DP ← 6
DP(I) RESET
DP(2) RESET
43
C
FIG. 12-B
FIG. 12-B'
FIG. 12-B"

FIG. 12-B'
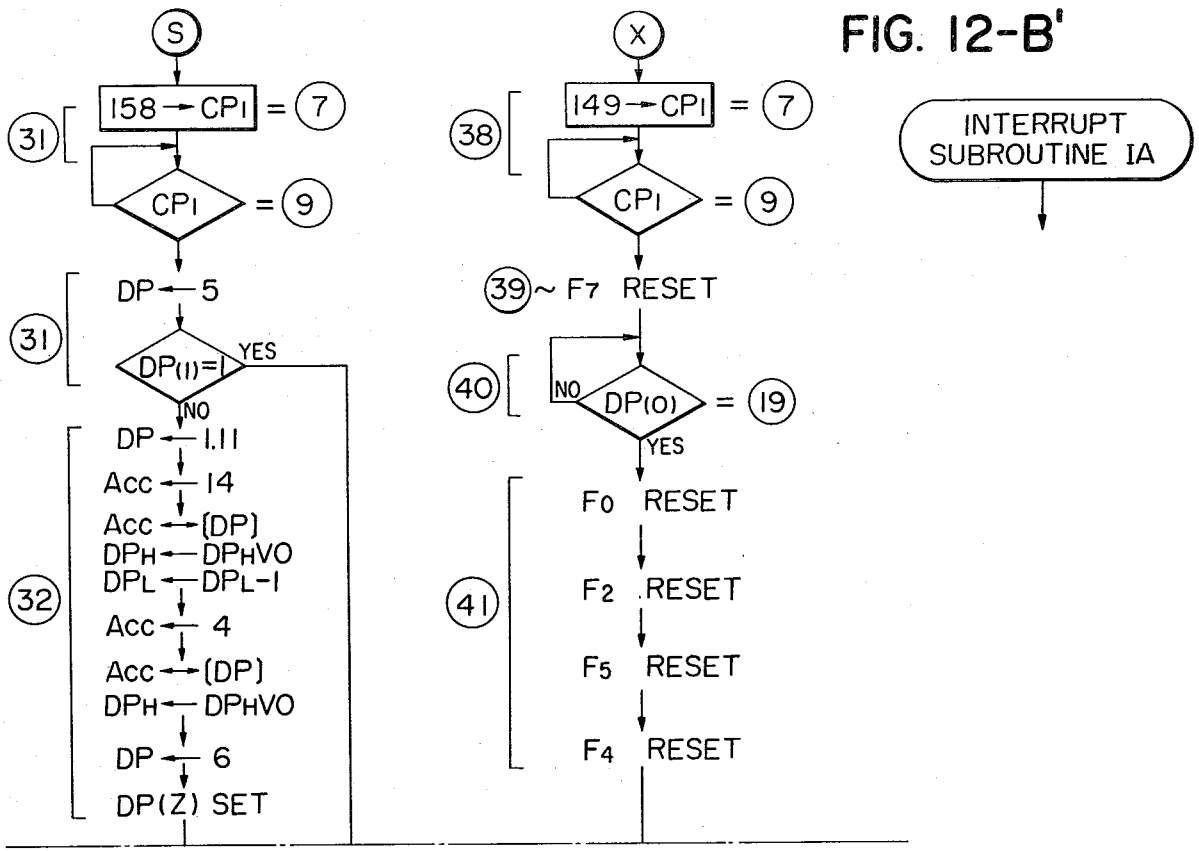

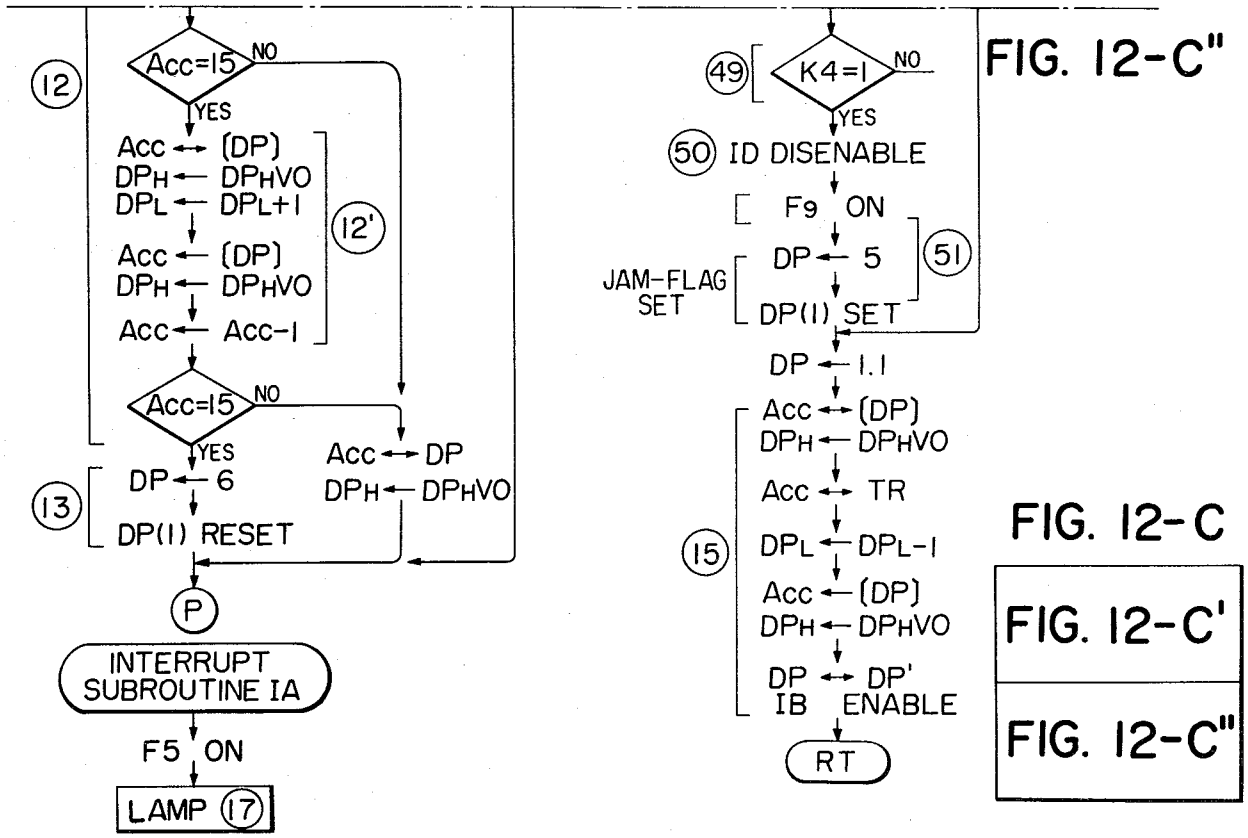
FIG. 12-C"
FIG. 12-C
| FIG. 12-C' | FIG. 12-C" |
|---|---|

FIG. 12-C'
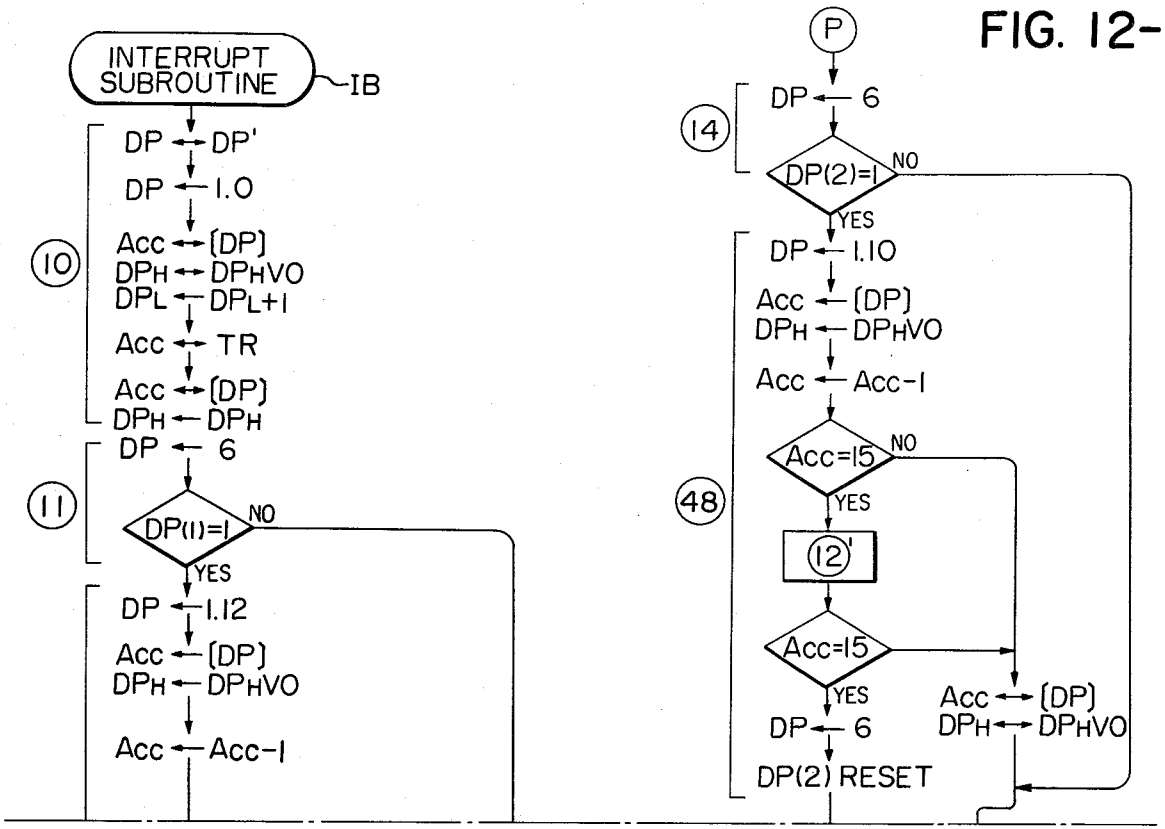

IMAGE FORMING PROCESS AND APPARATUS THEREFOR

This is a continuation of application Ser. No. 891,852, filed Mar. 30, 1978 now U.S. Pat. No. 4,202,622.

BACKGROUND OF THE INVENTION

1. Field of the Invention

The present invention relates to an image forming process with a stored program control and an apparatus therefor.

2. Description of the Prior Art

The present invention, though being explained in the following with reference to an electrophotographic apparatus, is also applicable to a printer for data print-out. In general an apparatus for automatic repeated formation of an electrophotographic image comprises a rotary photosensitive member around which there are provided, in the direction of rotation thereof, a means for forming an electrostatic latent image, a means for developing said latent image, a means for transferring the developed image onto a transfer sheet and a means for cleaning said photosensitive member for succeeding formation of electrostatic latent images thereon, wherein various devices for process steps have to be controlled with predetermined timings.

In the conventional process control the timings of functioning loads are determined by the signals from cam switches actuated by cams operated in connection with the angle of said rotary photosensitive member, or by counting a series of pulses generated by the rotation of said photosensitive member. In such case, if said cam signals or pulse signals are supplied to a so-called computer to control the sequential release of timing function signals, it becomes necessary to constantly inspect the generation of such cam signals or pulse signals, and it is difficult to achieve a process other than the sequence function. Particularly in the latter case, since the frequency of clock signals for data processing in the computer (for example 1 $\mu sec^{-1}$) is much higher than that of the above-mentioned pulse signals, it becomes necessary to realize certain timing processes between the computer operations and pulse counting, thus requiring additional programs and memories. Further, in case of a sequential process control of a copying process with a computer, the programmed control allows for detection of an emergency such as paper jamming only at predetermined timings, giving rise to possibly the application of safety measures.

SUMMARY OF THE INVENTION

The object of the present invention is to provide an image forming process with stored program control free from the above-mentioned drawbacks and an apparatus therefor.

Another object of the present invention is to provide an image forming process and an apparatus therefor utilizing a digital computer and capable of detecting the operational state of the machine, and performing corresponding process functions in real time.

Still another object of the present invention is to provide an image forming process and an apparatus therefor utilizing stored program control and capable of performing timing functions of process control with a relatively small memory capacity.

Another object of the present invention is to provide an image forming process and an apparatus therefor utilizing stored program control and capable of immediately detecting various troubles of the machine and taking necessary safety measures.

Another object of the present invention is to provide an image forming process and an apparatus therefor provided with a control system effectively performing sequenced operations of various loads for process control and safety functions such as appropriate indication or power cut-off in response to troubles appearing during the course of the process control.

Another object of the present invention is to provide a transfer-process electrophotographic apparatus utilizing a controller wherein a data RAM, a program ROM, a processing register and an I/O latch port are incorporated in a semi-conductor element.

The above-mentioned and other objects of the present invention will be achieved by the embodiments of thereof explained in the following.

BRIEF DESCRIPTION OF THE DRAWINGS

FIGS. 12-A, 12-B and 12-C are detailed flow charts according to FIG. 6.

DESCRIPTION OF THE PREFERRED EMBODIMENTS

Figure 1:
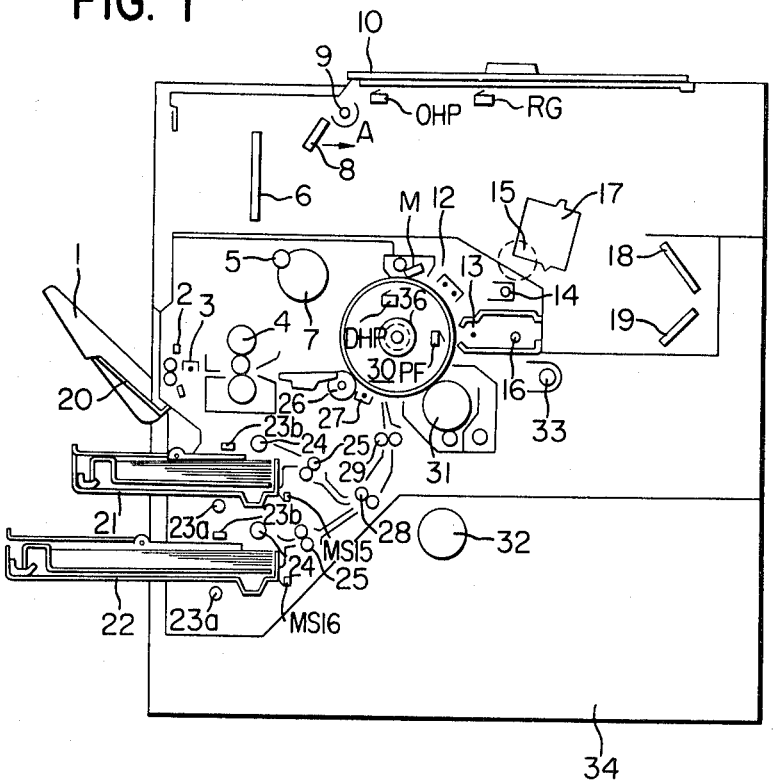
FIG. 1 is a cross-sectional view of a copying apparatus embodying the present invention.

Referring to FIG. 1 which is a schematic cross-sectional view of an electrophotographic apparatus embodying the present invention, there will be explained the process and the functions of various loads therein for the process performance.

An original to be copied is placed on an original table constituting an original support surface and is maintained in place by means of an original pressure plate 10. An optical system is composed of an illuminating section 101 consisting of an illuminating lamp 9 and a movable mirror 8, a movable mirror 6, a lens 17 and stationary mirrors 18 and 19. Thus the image of said original is focused on the photosensitive surface of a rotating drum 30 through a movable mirror 8 displaced in the direction of arrow A integrally with the illuminating lamp 9 and a movable mirror 6 displaced in the same direction with a speed equal to ½ of the displacing speed of said movable mirror 8, said movable mirrors functioning to maintain the length of light path constant, and further through the lens 17 and stationary mirrors 18 and 19, whereby the original is scanned and slit exposed by the illuminating section. The drum 30 is provided on the periphery thereof with a photosensitive layer covered with a transparent insulating layer, said photosensitive layer being charged positively by means of a DC charger 12 receiving a positive high-voltage current from an high voltage source (not shown). Upon arrival of the photosensitive layer at the exposure section 16, the original placed on the original support is illuminated by the lamp 9 and is focused on the drum 30 the aforementioned movable mirrors, lens and stationary mirrors, and said photosensitive layer is simultaneously subjected to an AC charge elimination by means of an AC discharger receiving an AC high-voltage current from a high-voltage source during the exposure of said drum to the image of said original.

Successively the photosensitive drum surface is subjected to a flash exposure with a flash exposure lamp 33 thereby forming an electrostatic latent image on said surface, which is successively guided into the developing section 31.

The development is conducted by powder development with a developing sleeve, thereby rendering said electrostatic latent image visible.

The foregoing and following process steps are conducted during the rotation of said photosensitive drum.

A transfer sheet is supplied from a cassette 21 or 22 by a feed roller 24, advanced by the first rollers 25 and second rollers 28 and temporarily stopped by the rollers 29 when a timing roller clutch CL is disconnected the clutch is reactivated upon receipt of a register signal to start rotation of the rollers 29 thereby restarting the advancement of transfer sheet. Said register signal is obtained from a switch RG detecting the passing of the optical system through a determined position. Also a switch OHP generates a signal indicating the home position of the optical system.

The transfer sheet thus advanced is brought into close contact with the rotary drum, and the image formed on said drum is transferred onto said transfer sheet by a positive high-voltage current applied in a transfer charger 27. Upon completion of transfer, the transfer sheet is separated from the drum by a separating roller 26 and guided to a fixing roller 4 for thermal fixing of the transferred image. Upon completion of fixing the excessive charge is eliminated by a charge eliminator 3, and the transfer sheet is ejected to a tray 20 by ejecting rollers to complete the copying cycle. On the other hand the photosensitive drum surface is cleaned by a blade 11 maintained in pressure contact for removing the remaining toner, and thus is prepared for the succeeding cycle. A switch DHP releases a drum home position signal to stop the drum in a position wherein the splice of the photosensitive element coincides with the cleaner 11. 23*a* and 23*b* are a known pair of a lamp and a light-receiving element for detecting the presence or absence of transfer sheets in the cassette, 2 is a known pair of a lamp and a light-receiving element for detecting the delay in sheet advancement and the jamming thereof in this position. 16 is a blank exposure lamp for illuminating the photosensitive member, in the absence of image exposure, to eliminate unevenness in the surface potential. 7 is a fixing motor, 15 is an optical motor, and 14 is a pre-exposure lamp for causing uniform fatigue on the photosensitive member prior to the process. Also 36 is a pulse generator composed of a disc rotated in connection with the drum and an unrepresented optical detector for detecting light pulses passing through the openings provided on said disc.

Figure 2:
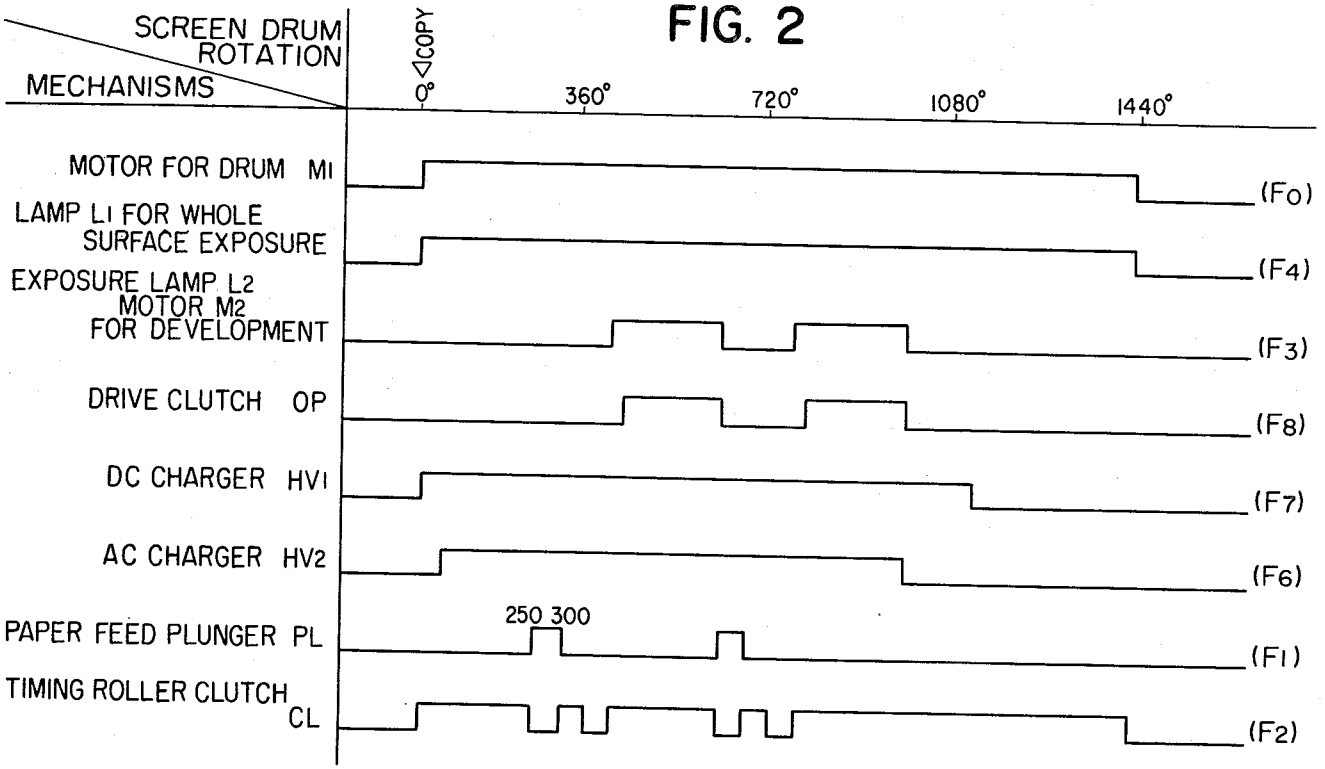
FIG. 2 is a function time-chart of the apparatus shown in FIG. 1.

FIG. 2 shows the functioning timings of principal devices necessary for the process performance. The afore-mentioned pulse generator releases one pulse for each rotation of 1° of the photosensitive drum.

Figure 4:
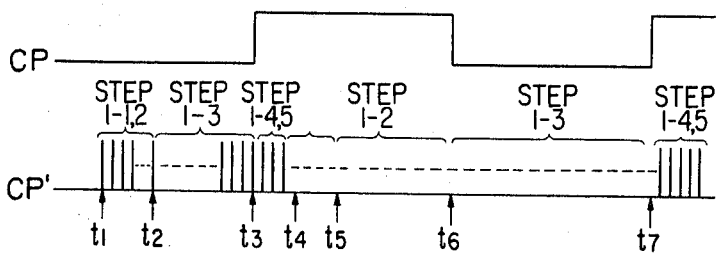
FIG. 4 is a time chart of the drum clock signals and the computer clock signals.
Figure 3:
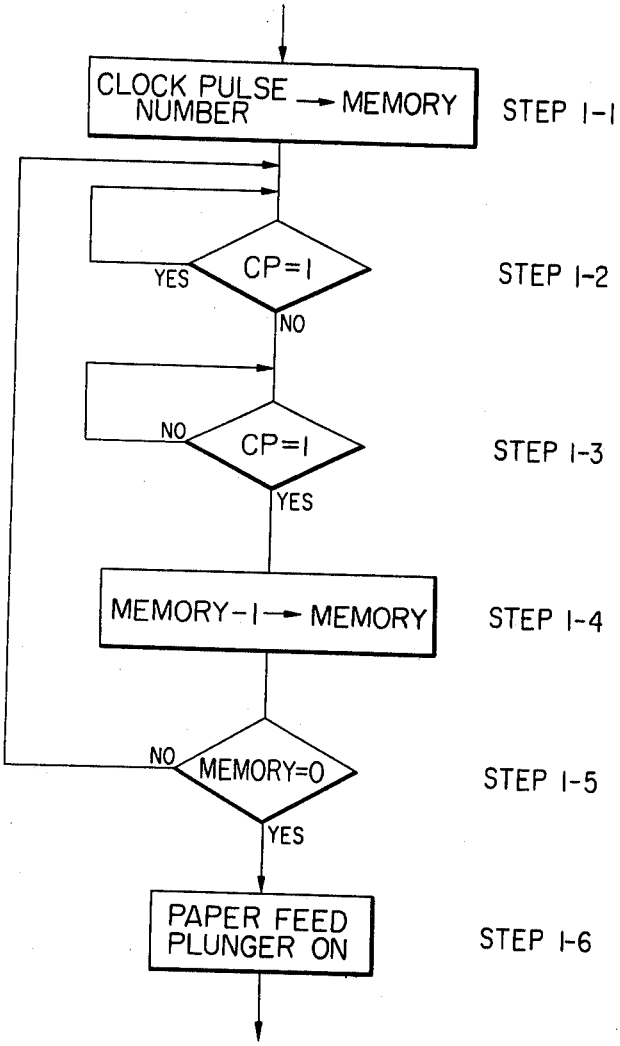
FIG. 3 is an example of flow chart for the timing control.

Now there will given an explanation, with reference to FIGS. 3 and 4, on the timing signal generation by means of a computer not provided with an interruption ability.

FIG. 3 shows an example of a program for connecting a clock pulse generator to the input terminal of a computer and counting the clock pulses associated with the drum rotation thereby generating timing signals. The execution of the abovementioned program is detailedly described in the Japanese Patent Application Ser. No. Sho 51-36614 or in the United States Patent Application Ser. No. 752,895.

FIG. 4 shows the comparison, on the same time axis, of the clock pulses CP′ of the computer and the clock pulses CP generated by the rotation of photosensitive drum. The step 1—1 in FIG. 3 is performed during the clock pulses from the time $t_1$ to $t_2$ in FIG. 4. The minimum instruction step for performing each step in FIG. 3 is to be executed during one clock pulse CP′.

By the execution of STEP 1—1 the pulse number for determining the process timing, for example 250 pulses for the timing of activating paper feed plunger, is read from a read-only-memory ROM and stored in a processing memory. At the timing $t_2$ the process proceeds to the STEP 1-2 and, CP being 0, further to the STEP 1-3, which is repeated during the period $t_2<t<t_3$ without proceeding to the next step. At $t_3$ where CP=1, the process proceeds to the STEP 1-4, which is executed within a period of several clock pulses between $t_3$ and $t_4$ whereupon the pulse number stored in the memory is reduced by 1. Successively during a period from $t_4$ to $t_5$ the STEP 1-5 is executed to identify if the stored number after deduction is 0, and the process returns to the STEP 1-2, which, as CP still being 1, is repeated during the period from $t_5$ to $t_6$. At the $t_6$ where CP=0, the process proceeds to the STEP 1-3 which is repeated until $t_7$. In this manner a clock pulse CP is supplied during the period from $t_1$ to $t_7$, and is counted by the execution of the STEP 1-4 upon reaching a state CP=1. The STEP 1-5 identifies if the counting of clock pulses of a predetermined number has been completed, and the STEPS 1—1 to 1-4 are repeated until the completion of counting. Upon completion of said counting the STEP 1-6 is executed to release a function signal for a determined function device from the computer. For example upon completion of counting of 250 pulses a signal for activating the paper feed plunger is released from a corresponding output terminal of the computer.

In this manner the synchronization between the clock pulses CP generated in synchronization with the rotation of the photosensitive drum and the functions of computer is realized by the STEPS 1-2 and 1-3, wherein the pulse counting is performed by identifying the leading end and trailing end of the clock pulses.

Figure 5:
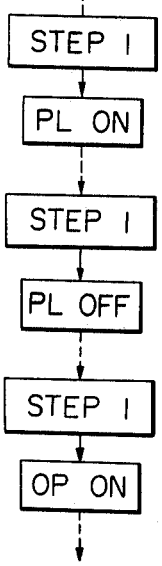
FIG. 5 is an example of flow chart for the process sequence control according to the flow chart shown in FIG. 3.

In the above-mentioned control system such clock pulse counting steps are required in a number corresponding to the number of process control loads requiring the timing control, and the group of such steps is time-sequentially incorporated into the sequence control program as shown in FIG. 5. In such control system it is hardly possible to perform control of other function devices between such counting steps.

In contrast thereto, according to the present invention, the clock pulse counting and output control is performed by connecting a drum clock pulse generator to an interruption port instead of an input port, thereby enabling to control other function devices between the clock pulses.

Figure 6:
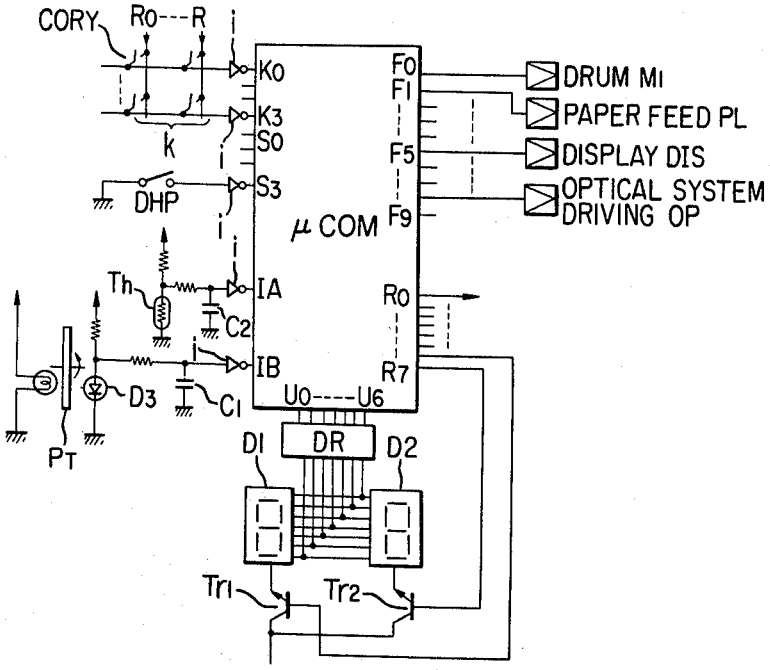
FIG. 6 is an example of control circuit for use in the present invention.
Figure 7:
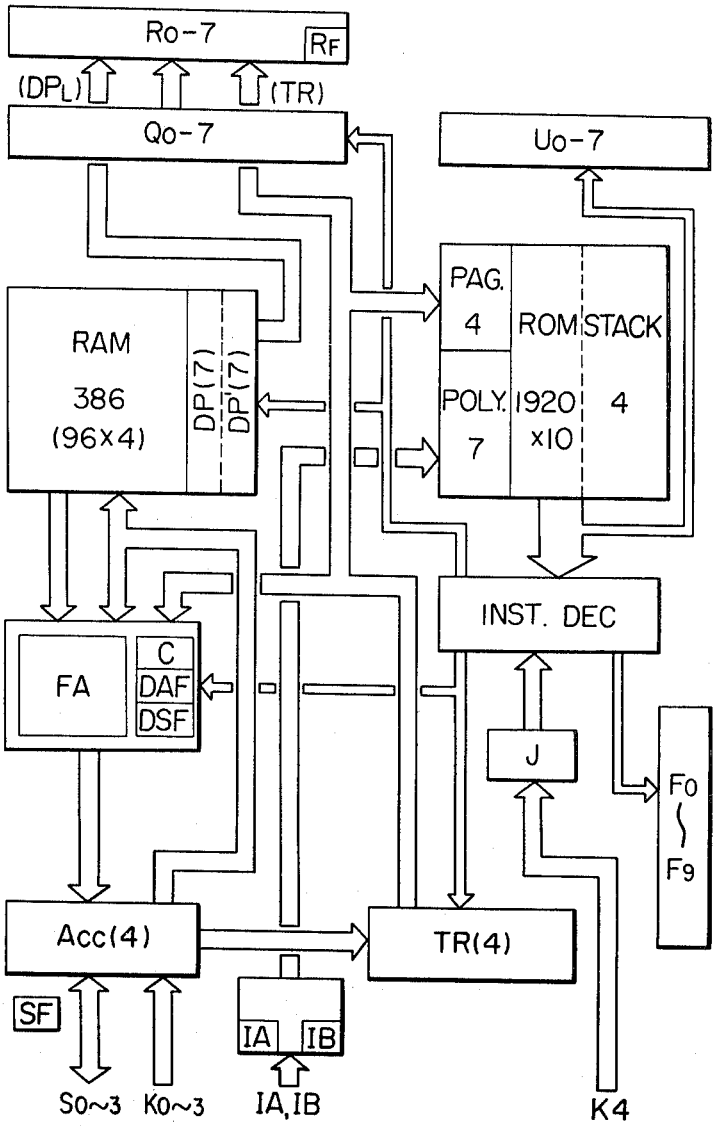
FIG. 7 is a diagram of the internal circuit of the micro-computer element shown in FIG. 6.

FIG. 6 shows the specific circuit structure of the present invention wherein μCOM is a known microcomputer of which internal circuits are shown in FIG. 7. IA and IB are interruption ports of which the latter is connected to a light-receiving element D3 for generating drum clock signals and a wave forming condenser C1, while the former is connected to a trouble detecting circuit for detecting troubles occurring in the copying apparatus. D1 and D2 are display devices for indicating the number of copies, DIS is a display device for alarm, Tr1 and Tr2 are amplifying transistors, COPY is a copy start button, K are numeral key buttons of 0–9 for setting the copy number, and DHP is a microswitch for detecting the home position of drum. Said display devices D1 and D2 are connected through a driver to the segment selecting output ports U0–U6. The motor M1, alarm display DIS etc. are connected to the output ports F, while the DHP and COPY are respectively connected to the ports S and K. i in the drawing represents an inverter.

The actuation of the COPY key or numeral keys is scanned by the time-divided signals from the output ports R0–R3 and supplied as dynamic input to the input ports K0–K3. Upon receipt of said input signal, the computer initiates the rotation of drum motor M1, upon which a disc PT rotating therewith generates intermittent light signals which are detected by the light-receiving element D3 to generate drum clock pulses. Upon release of the DHP signal at the home position of drum by an optical detecting switch, there is started the counting of 250 drum clock pulses CP for activating the paper feeding plunger. This is achieved, upon input of the DHP signal into the input port S3, by accepting the drum clock signals at the interruption port IB. Upon completion of counting of a predetermined number of pulses, the output port F1 releases a drive signal to energize the paper feed plunger PL whereby the constantly driven paper feed roller is lowered to initiate paper feeding. Said plunger is deactivated upon further counting of 50 pulses, and upon counting of 100 pulses from the succeeding DHP signal a plunger OP for driving optical system is activated in a similar manner as explained above to initiate the displacement of the optical system and simultaneously start the exposure. The deactivation of the above-mentioned devices and the functions of other devices are also controlled in a similar manner.

In the following there will be given a brief explanation on the computer with an interruption function adapted for use in the present invention. In the foregoing embodiment there is employed a 4-bit micro-computer μPD 545 manufactured by Nippon Electric Co., of which circuit block diagram is shown in FIG. 7, wherein ROM and RAM are memories, PAG is a page register for designating a memory group in ROM, POLY is a step counter for designating the memory address in said group, DP is a data pointer for designating the register address in RAM, DP' is a data pointer for storing said address in case of interruption, STACK is a memory for storing the ROM address in case of interruption, INSTDEC is a decoder of instructions from the ROM, F0–F7 are output ports, Q0–Q7 are a serial-parallel converting register, R0–R7 and U0–U7 are output ports, FA is a processing circuit, ACC is an accumulator, TR is an auxiliary register, IA and IB are interruption ports, S0–S3 are input/output ports, and K0–K3 are input ports. The above-mentioned input-/output ports and interruption ports correspond to those shown in the circuit of FIG. 6.

The above-mentioned read-only memory ROM is utilized for storing the sequence control program for the copying process, in the form of instruction codes and also for storing the clock numbers for process control, while the random access memory RAM is utilized for temporarily storing the data necessary for the execution of process control and setting flags for identification.

The instruction code signals are read, in succession, from the ROM by means of the computer clock pulses and decoded by the decoder INSTDEC to generate control signals for executing the ROM program.

Figure 8A:
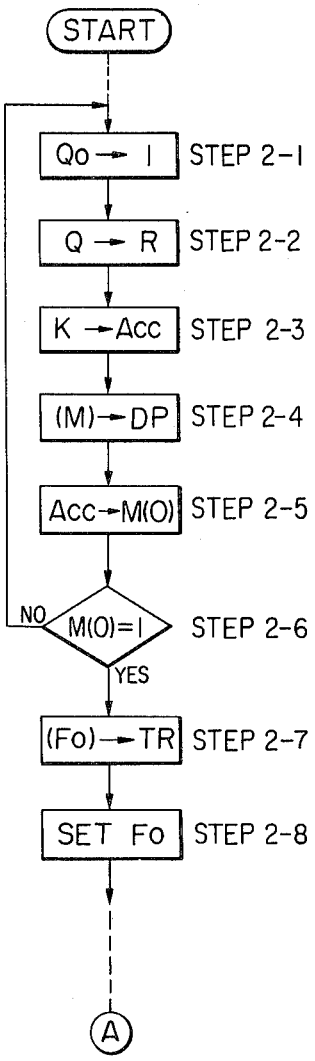
FIGS. 8(A), 8(B) and 9 are examples of flow charts for sequence control in FIG. 6.
Figure 8B:
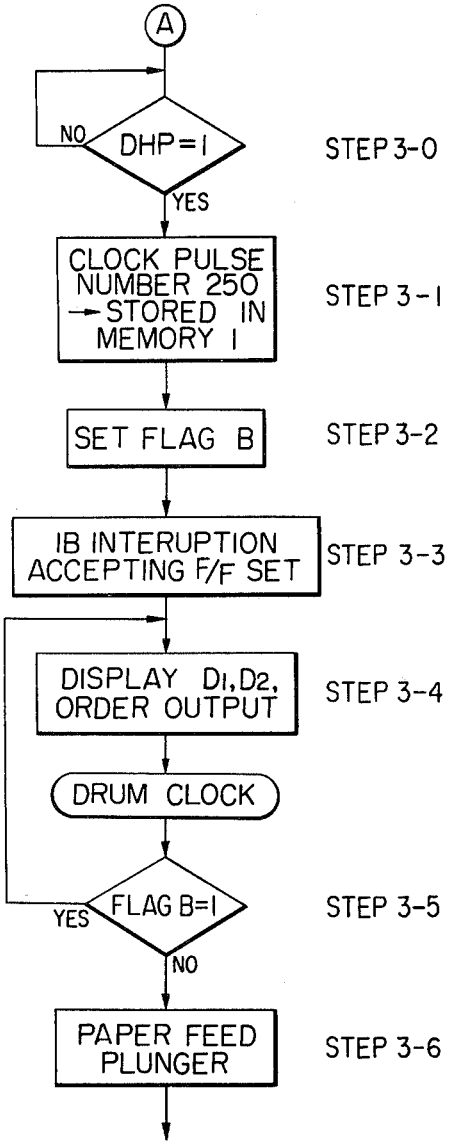

FIG. 8 shows an example of flow chart of a main program stored in the ROM, and in the following there will be given an explanation on the process of copy key entry with reference to FIG. 8(A).

Upon power supply to the computer to initiate the functions thereof, the computer designates the ROM address according to the computer clock signals to release an instruction code to execute the ROM program. The step 2–1 sets the first bit Q0 of the register Q. In the step 2—2 the 8 bits Q0–Q7 of said register are supplied to R0–R7. In the step 2–3 the input data to the input port K is stored in the accumulator ACC. At the same time, as R0 is at high level, the input level to K0 indicates if the COPY button was actuated or not. Upon storage of a data corresponding to K0–K3 into the accumulator ACC, a bit corresponding to K0 stores a signal "1". In the succeeding step 2–4 data designating the RAM address is stored in the register DP, and in the step 2–5 the data stored in the accumulator ACC in the step 2–3 is transferred to the address (00) (cf. FIG. 13) of RAM designated by said register. In the step 2–6 it is determined if the 0-th bit of said data is "1" or not. If it is "1" (yes), the succeeding step 2–7 is executed to read a data for designating the output port F0 from the ROM and store said data in the register TR. The succeeding step 2–8 sets the output port F0 of which an output is supplied through the driver to start the drum drive motor. In case, in the step 2–6, the 0-th bit is "0", the flow is repeated from the step 2–1.

Now there will be explained, with reference to FIG. 8 (B), the drum clock counting by interruption in case of counting 250 clock pulses for releasing a drive signal for the paper feed plunger.

The step 3–0 identifies if the drum home position signal is supplied to the input port S3 according to a program flow similar to the one explained in the foregoing. In the step 3–1 a code for "250" is read from the ROM and stored in the RAM. The step 3–2 sets the flag B in the flag register of RAM to "1". The step 3—3 sets a flip-flop for accepting interruption to the interruption port IB, thus enabling the interruption by the drum clock pulse. In the succeeding step 3–4 the ports R6 and R7 release time-divided signals for switching the orders of indicator in combination with the segment signals from the ports U0–U6 to perform dynamic display on the display devices D1 and D2. This step includes a number of instruction codes from ROM code readout to output from output ports, which are already known in the art and are therefore not explained in detail. The display devices D1, D2, each consisting of seven light-emitting segments, display the number set by the key entry, said number being subtracted by one at the completion of each copying cycle, and said display is performed intermittently in this step. In the step 3–4 there is identified the state of the flag set in the step 3–2, and if there is no change in the state the step awaits the flag resetting. If there is generated a drum clock pulse 7 during said waiting, the leading end of said pulse applied to the port IB resets the flip-flop for interruption acceptance to allow the interruption input, whereby the ROM address indicated by the program counter POLY is retracted to the register STACK and a particular address of ROM (for example "100") is newly designated by said counter POLY. The ROM stores an interruption routine program as shown in FIG. 9 starting from the address "100", which is executed upon receipt of the leading end of said drum clock pulse.

In this manner the main program which has been in execution is interrupted, and there is executed the program for counting drum clock pulses, upon completion of which the address stored in the register STACK is returned to the counter POLY to continue the main program from the succeeding address.

Figure 9:
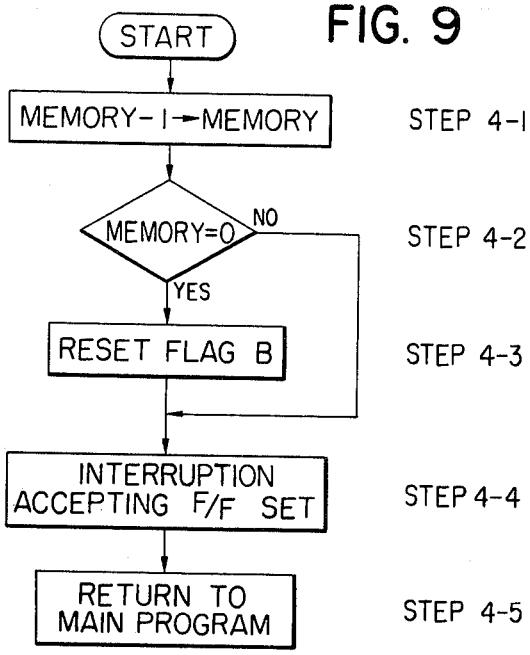

FIG. 9 shows the above-mentioned interruption routine program wherein the step 4–1 subtract "1" from the value "250" memorized in the step 3–1, and the step 4–2 identifies if the value after subtraction has reached "0". Said value not being zero as this is the first drum clock pulse after the detection of drum home position signal DHP, the program skips the step 4–3 and proceeds to the succeeding step 4—4 which performs the setting of the flip-flop in order to allow re-interruption when the process returns to the main program. By the succeeding step 4–5, the program returns to the step 3–4 of the main program in case the leading end of the drum clock pulse has occurred directly before the step 3–4.

In this state the display devices D1, D2 are again put into operation. Upon entry of the succeeding clock pulse CP into the port IB, the flip-flop which in the set state is reset at the leading end of said pulse CP to again perform the counting routine program by interruption.

Upon completion of counting 250 pulses in this manner, whereupon as a result of subtraction the counting reaches zero, the step 4–3 is executed to reset the flag B. Thus, upon returning to the main program, the program proceeds through the step 3–5 to the step 3–6 to set the output port F1 thereby activating the paper feed plunger PL.

The timing controls for other devices such as lamp L1, drum drive motor M2, optical system drive clutch OP, first charger HV1, second charger HV2 and timing roller drive clutch CL are achieved in the same manner.

Figure 10:
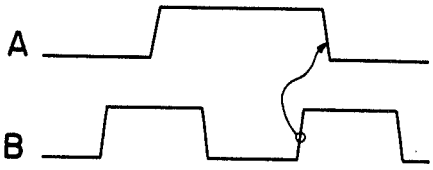
FIG. 10 is a time chart showing interruption accepting.

FIG. 10 shows the signal A which is an output signal from the flip-flop connected to the interruption port, and the signal B which is a drum clock pulse signal to be supplied to the port IB. Said flip-flop, or namely the signal A, is reset at the leading end of the signal B to prohibit the interruption to the port IB. Also the signal A, upon being set by the accepting instruction (step 3—3), is not reset until the detection of the leading end of a signal B. The same also applies to the port IA.

The interruption port IA is provided in order to perform an interruption of a higher priority than for the port IB. Thus, by connecting a trouble detector to said port IA and the above-mentioned pulse generator to said port IB, it is rendered possible to immediately give an alarm or to interrupt the function of the copier when a trouble in the copier is detected by said trouble detector.

Upon input of an interruption signal to the port IA when the flip-flops of the ports IA and IB are in set state, said flip-flops are reset to perform the program of the ROM address designated by the port IA in the manner as described before. Thus the clock signals to the port IB are not accepted. On the other hand, in case of input of a clock pulse signal to the port IB, the flip-flop of the port IB alone is reset. Thus upon the succeeding generation of a trouble signal to the port IA, said trouble signal is readily accepted to terminate the function of the copier regardless if or whether the port IB is in the interruption program (input of drum clock pulse CL).

Figure 11:
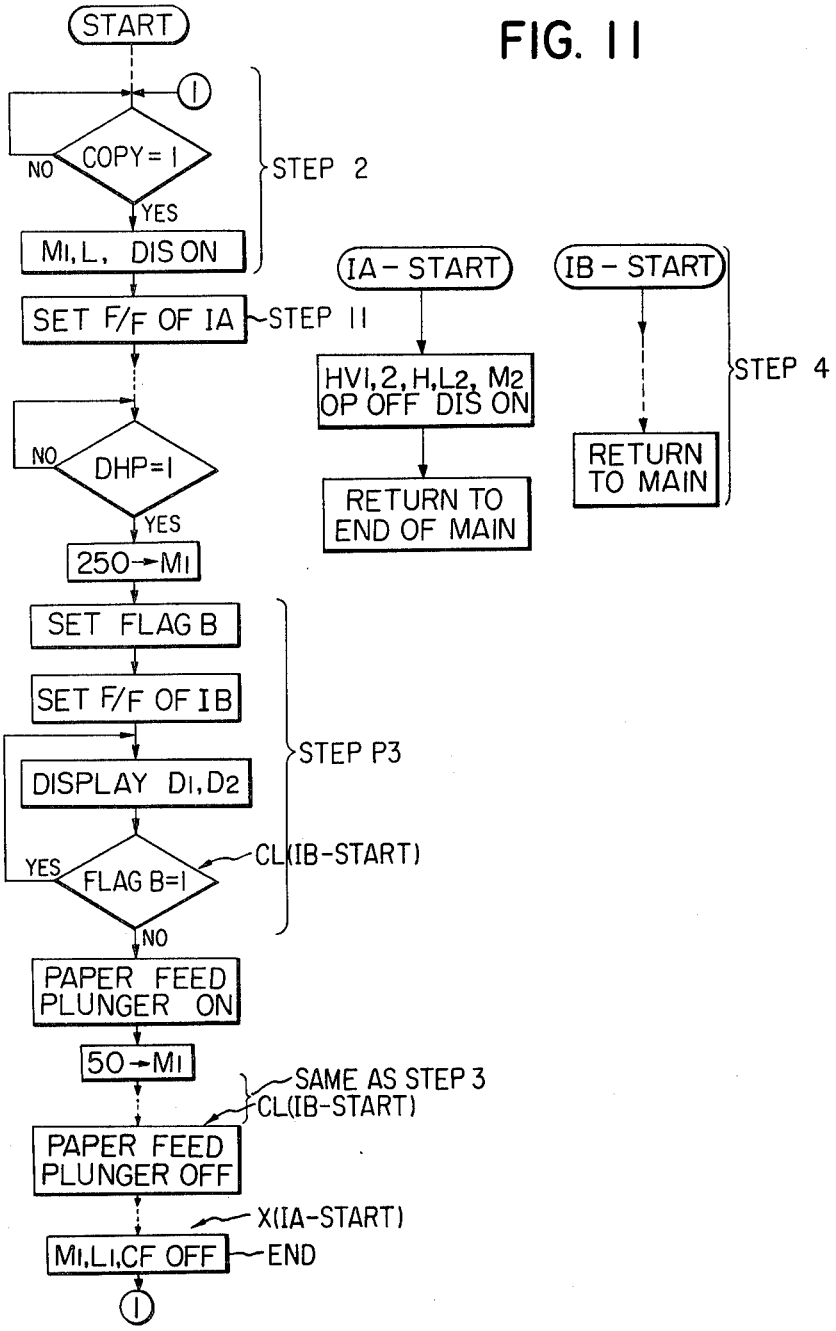
FIG. 11 is an another example of flow chart according to FIG. 6.

FIG. 11 is a flow chart indicating functions, after the identification of whether the COPY instruction is given in the step 2, for setting the flip-flop of the port IA in the step 11 and executing the program starting from the step 3 for clock counting as described before to complete the copying process. A trouble signal X occurring in any step of this process cycle will interrupt said step and cause the interruption flow IA-START to be executed thereby switching off the high-voltage source HV1, HV2, heater H, lamp L2, developer M2 and drive system OP and switching on the display device DIS, thus proceeding to the end cycle. In this manner the copier functions (drum motor M1, lamp L1 and clutch CL) are terminated. The alarm display DIS is reset by actuating an unrepresented reset button after a safety measure is taken against said trouble.

For detecting troubles there are provided a circuit for detecting an abnormal temperature in the copier (in the fixing device) and a circuit for detecting paper fire. Also it is possible to provide similar circuits for detecting the absence of a transfer sheet in the cassette or detecting the lack of developer (FIG. 1; 23*a*, 23*b*). Further it is possible to detect the jamming of a transfer sheet in the path therefor and to detect the paper feed failure from the cassette. In case the circuits for detecting the paper jamming or the failed feed are connected to the interruption port, it is possible to stop the drum in a position after the surface charge elimination by shifting the program, upon receipt of trouble signal, to the drum post-rotation cycle directly prior to the end cycle.

A paper jamming detection can be achieved for example by a circuit wherein a timer is started at the start of paper feeding and is reset upon detection of paper by a paper detector 2 (FIG. 1) positioned at the paper path exit within a determined timer period, while a jamming detection signal is given by the output of said timer in case of no paper detection, or wherein the jamming detection signal is obtained by the output of an another timer when the paper does not pass through the detector 2 within a determined period of said another timer.

Also a defective paper supply can be detected by a circuit wherein a timer is started at the start of paper feeding and the failure detection signal is obtained when a paper detector (not shown) positioned in the vicinity of the paper feed rollers is not actuated within a determined timer period or wherein a diagonal paper supply is detected.

As detailedly explained in the foregoing, the present invention realizes an easier timing control and allows a faster application of safety measures by connecting the circuits for detecting the state of the image forming process (for example detecting timings and troubles) to the interruption port, particularly plural ports, of the computer.

FIGS. 12A, B and C show detailed flow charts corresponding to FIG. 11 and presented in word mode as shown in a FIG. 8A. Each step corresponds to the instruction code of μPD 545, wherein the meaning of each code is not explained here as it is evident from the manual therefor.

Figure 13:
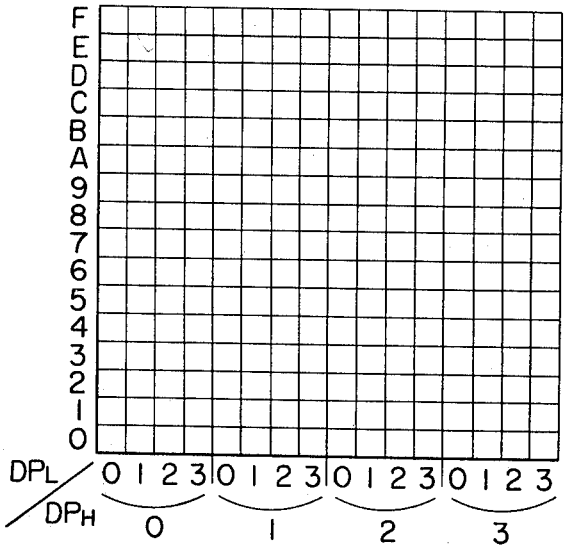
FIG. 13 is a bit diagram of the RAM.

The flow proceeds by the disenabling of the acceptance of port IA in the step 1; the key entries by the copy number set keys and the copy key in the step 2; enabling the acceptance of the port IA in the step 3; starting of motor M1, lamp L1, DC charger HV1 and roller clutch CL in the step 4, the passing of the drum home position through the switch DHP in the step 5; and switching on of the AC charger HV2 in the step 6. There follows the step 7 for setting the number of clock pulses CP ("250") for starting the paper feed roller in the RAM, and the step 8 for setting an interruption flag in the RAM and setting the flip-flop to enable the accepting at the port IB. The RAM memory structure is shown in FIG. 13. The instructions DP-1, 13 and DP-6 respectively indicate addresses wherein ($DP_H$, $DP_L$) in the RAM is equal to (1,13) and (0,6), and DP(1) indicates the first bit data in said address. In case of no input of pulses CP to the port IB, the sub-routine SUBP of step 9 for display is repeatedly executed. Upon receipt of a pulse CP, the flip-flop corresponding to the port IB is reset to disenable the accepting at the port IB, and the program proceeds to the interrupt subroutine. In the step 10, the data in the accumulator ACC and register TR are stored in a suitable addresses in the RAM. The step 11 identifies the flag setting for the timing function, and, if the setting is completed, the program proceeds to the step 12 for subtracting "1" from the set copy number. The result of subtraction not being zero, the program proceeds to the step 14 to identify if the pulse number for jam detection is set, and if it is not set in this state, the step 15 is executed to recall the data of ACC and TR from the RAM and to enable the accepting at the port IB, after which the program returns to the step 9 to execute the display routine. Upon counting 250 pulses the interrupt flag is reset by the step 13, and the program proceeds through the steps 14 and 15 to the step 16 for identifying the stop key input. In case said input is present, there follows the step 17 to switch off the chargers HV1 and HV2, the step 18 to disable the accepting of a signal to the port IB and to rotate the drum home position is detected by the signal DHP. Then executed is the step 20 to switch off the motor M1, lamp L1 and roller clutch CL, and the program returns to the key entry routine of the step 2. In case said stop key input is not present, there is executed the step 21 to switch on the paper feed plunger and switch off the timing roller thereby feeding paper. There follows the step 22 to set and count the pulse number for driving the timing roller in such a manner that the leading ends of the developed image and the transfer sheet mutually coincide in the transfer station; the step 23 to switch off the paper feed plunger and switch on the timing roller; the step 24 to set and count the pulse number for switching off the timing roller thereby switching off the timing roller; the steps 25 and 26 for awaiting the turning on and off of the DHP signal; the steps 27 to switch on the exposure lamp L2 and developing motor M2; the steps 28 and 29 to count the pulse number 22 and to switch on the optical system drive clutch OP and roller clutch CL thereby initiating the exposure by scanning; the step 30 to set and count the pulse number for terminating the exposure; the step 31 to identify the jam flag which is to be set in case of a jam detection, said step being followed by the step 34 in the absence of a jam flag setting; the step 32 to store a pulse number 228 for jam detection in the address (1,11) of the RAM and to set the counting flag in the address (0, 6) wherein the pulses in this case are called CP2; the step 33 to switch off the lamp L2 and clutch OP and to return to the optical system to the start position by means for example of a spring; the step 34 to again identify if the stop key is turned on, to again identify the jam flag in case the stop key is off, to add "1" to the copy number in the determined address of the RAM, to compare the result of addition with the set number in the RAM entered by the key entry in the step 2, and to return, in case of no coincidence, to the step 21 thereby performing paper feeding for the succeeding copying cycle; the step 37 to switch off the AC charging in case there is identified the entry of stop key, jam flag setting or coincidence of copy number with the set number in the step 34, 35 or 36; the step 38 to count 149 pulses CP1; the step 39 to switch off the DC charger; the step 40 to identify the turning on of the switch DHP after one rotation of the drum; the step 41 to reset F0, F2, F4 and F5 and to stop the motor M, lamp L1, clutch CL and jam display; the step 46 to disenable the accepting to the ports IA and IB; and the step 47 to reset the flag for counting pulses CP1, CP2 to return to the key entry step 2. In case the copy number does not coincide with the set number in the step 36 or in case the program is interrupted by the drum pulse in the step 22 there are executed the steps 10–14 in the above-mentioned manner, which are however followed by the step 48 due to the flag setting for counting jam detection pulses CP2. This step, similar to the step 12, subtracts "1" from the set number 228, and the program returns through the step 15 if the result of subtraction is not zero. After the setting CP2 flag 228, the program is interrupted at each entry of pulse to the port IB to execute the step 48, but the counting for the timing output is disenabled by the step 11. When the pulse count number reaches zero, the step 49 is executed to reset the flag CP2 and to check the input port K4. If the paper is not detected at this stage by the exit detector 2, the port IA is disenabled and F9 is set to function the jam display and to set a jam flag in the RAM (0, 5) (steps 50 and 51) whereupon the program returns through the steps 22 and 28 to the step 37 to reset the AC charger (F6) and proceeds to the aforementioned end mode. On the other hand, upon paper detection the program returns through the step 15 and set 228 at the end of exposure to repeat the above-mentioned steps. In these steps Acc⇄[DP] indicates the exchange of the content of accumulator with that of data pointer, and DPH←DPHVO indicates not to change the low state of RAM. The INTERRUPT SUB IA a program for detecting failed paper supply. In case a known detector (not shown) located close to the exit side of roller 25 detects a skewed supply of paper from the cassette, the program executes the step 51 to set the port F5 thereby activating the display and jumps to the step 17.

The ports IA and IB are structured to be triggered beyond a certain input level. This property is effectively utilized in the present invention, whereby the detecting operations can be achieved by direct input of analog voltage from a thermister Th as shown in FIG. 6 if the related resistors are suitable selected, thus avoiding the conversion to digital values. A similar result is obtainable by connecting a known optical detector for detecting toner concentration to this port, thus allowing to control the toner replenishment. Similarly it is possible to maintain the temperature of a fixing heater constant by controlling the current thereto through detection of voltage change at the port IA resulting from the temperature decrease of the thermister. Furthermore it is possible to maintain a constant surface potential at a constant concentration by connecting a surface potential meter to said port IA and controlling the chargers HV1, HV2 or the developing bias potential in response to the change in the surface potential of the photosensitive member.

As explained in the foregoing, the port IA is connected to the detectors of higher priority while the port IB is connected to the detectors for example for the absence of paper or toner, which in general allow relatively slow reaction. In case there are provided three or more interrupt ports, a further effective connection is realizable by suitable distribution of these detectors.

What we claim is:

1. An image forming apparatus comprising a recording member, elements operable for forming an image on said recording member, at least one of said elements being movable, means for detecting a predetermined position of said at least one movable element, means for generating a signal for effecting timed functions of said elements, and digital control means provided with a stored main program for actuating said elements for image formation, said digital control means comprising a stored interrupt program to be executed upon interruption of the execution of said stored main program, an interrupt input port for causing execution of said interrupt program, and a normal input port for advancing the execution of said main program, said signal generating means and said detecting means being connected to said interrupt port and said normal port, respectively, to control said timed functions in response to the signal generating means and said detecting means.

2. An apparatus according to claim 1, wherein said signal generating means generates a series of pulses, and said digital control means controls said timed functions of said elements in accordance with the pulses.

3. An apparatus according to claim 2, wherein said digital control means starts counting pulses in response to said detecting means.

4. An apparatus according to claim 2, wherein said control means checks jamming of the recording member in response to the counted pulses.

5. An apparatus according to claim 1, wherein said predetermined position is a position at which said movable element stops.

6. An apparatus according to claim 5, wherein said movable element is stopped in response to said detecting means.

7. An apparatus according to claim 6, wherein said movable element is a rotatable member for bearing an image to be transferred to the recording member.

8. An apparatus according to claim 1, wherein said digital control means comprises means for inhibiting the execution of said interrupt program until an initial signal is received from said detecting means.

9. An apparatus according to claim 1, wherein said digital control means is a single chip semiconductor comprising said stored main program, said stored interrupt program, said interrupt input port and said normal input port.

10. An image forming apparatus comprising a recording member, elements operable for forming an image on said recording member, a single means for detecting an operational state of said apparatus, and digital control means provided with a stored main program for actuating said elements for image formation, said digital control means comprising a stored interrupt program to be executed upon interruption of the execution of said stored main program, and an input port for receiving a signal for initiating the execution of said interrupt program, wherein said stored interrupt program identifies failures of the apparatus and effects timed functions of said operable elements, said single detecting means being connected to said input port to execute said interrupt program for identifying the failure and for effecting said timed functions of said operable elements in response to a signal generated by said single detecting means.

11. An apparatus according to claim 10, wherein said detecting means generates a series of pulses, and said control means effects said timed functions in response to the pulse count.

12. An apparatus according to claim 10, wherein said digital control means provides timing pulses, counts said pulses and provides a memory for storing the pulse numbers counted from the start to end of the operations of said elements.

13. An image forming apparatus comprising a recording member, elements operable for forming an image on said recording member, means for detecting an operational failure of the apparatus, and digital control means provided with a stored main program for actuating said elements for image formation, said digital control means comprising a stored interrupt program to be executed upon interruption of the execution of said stored main program, an input port for causing execution of said interrupt program, and means for enabling the execution of said interrupt program, wherein said detecting means is connected to said input port to initiate, in response to detection signals the execution of said interrupt program while said interrupt program is enabled by said enabling means.

14. An apparatus according to claim 13, wherein said detecting means generates a failure detection signal, in response to which said control means initiates an indication of said operational status.

15. An apparatus according to claim 13, further comprising means for instructing the start of an image forming operation, and wherein said enabling means enables the execution of the interrupt program in response to said instructing means.

16. A copying or printing apparatus, comprising:

image forming means operable to perform a process in which an image is formed on a recording member, and including a movable member which is arranged to move during said process, means for detecting a predetermined position of said movable member to stop said movable member, means for generating an interrupt instruction, computer means operable to provide control of the operation of said image forming means in dependence upon the outputs of said detection means and said generating means, said computer means having a stored main program comprising instructions for the control of the operation of said image forming means, a stored interrupt program to be executed upon interruption of the execution of the stored main program, an interrupt input coupled to said generating means, but not to said detecting means, to receive a said interrupt instruction for causing execution of said interrupt program, and a normal input coupled to said detecting means for receiving a signal providing an instruction for use in the execution of said main program.

* * * * *

UNITED STATES PATENT AND TRADEMARK OFFICE

CERTIFICATE OF CORRECTION

PATENT NO. : 4,299,476

DATED : November 10, 1981

INVENTOR(S) : YOSHIHIRO KAWATSURA, ET AL.

It is certified that error appears in the above-identified patent and that said Letters Patent are hereby corrected as shown below:

Column 1

Line 49, delete "possibly";

after "the" insert --belated--

Column 2

Line 40, after "of" insert --a--.

Column 4

Line 19, after "of" insert --the--.

Column 6

Line 18, after "of" insert --a--.

Column 8

Line 11, change "if" to read --of-- delete "or".

Line 62, delete "detailedly".

UNITED STATES PATENT AND TRADEMARK OFFICE

CERTIFICATE OF CORRECTION

PATENT NO. : 4,299,476

DATED : November 10, 1981

INVENTOR(S) : YOSHIHIRO KAWATSURA, ET AL.

It is certified that error appears in the above-identified patent and that said Letters Patent are hereby corrected as shown below:

Column 9

Line 2, after "in" insert --a--.

Line 45, after "HV2" insert --and--.

Column 10

Line 43, change "disenabled" to read --disabled--.

Signed and Sealed this

Sixth Day of April 1982

[SEAL]

*Attest:*

GERALD J. MOSSINGHOFF

*Attesting Officer* *Commissioner of Patents and Trademarks*